US008692720B2

(12) United States Patent
Chang et al.

(10) Patent No.: US 8,692,720 B2
(45) Date of Patent: Apr. 8, 2014

(54) ANTENNA STRUCTURE

(75) Inventors: Ching-Wei Chang, New Taipei (TW); Yen-Chao Li, Taoyuan County (TW); Jian-Min Tsai, New Taipei (TW)

(73) Assignee: Auden Techno Corp., Taoyuan County (TW)

( * ) Notice: Subject to any disclaimer, the term of this patent is extended or adjusted under 35 U.S.C. 154(b) by 180 days.

(21) Appl. No.: 13/433,426

(22) Filed: Mar. 29, 2012

(65) Prior Publication Data

US 2013/0257665 A1 Oct. 3, 2013

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702, 846
See application file for complete search history.

(56) References Cited

U.S. PATENT DOCUMENTS 7,136,025 B2 * 11/2006 Lin et al. ..... 343/770
2012/0068887 A1 * 3/2012 Chiu et al. ..... 343/700 MS

* cited by examiner

*Primary Examiner* — Hoang V Nguyen
(74) *Attorney, Agent, or Firm* — Li & Cai Intellectual Property (USA) Office

(57) ABSTRACT

An antenna structure, used for being fed with a signal, includes a grounding portion, a radiation portion, and a frequency adjusting portion. The radiation portion has a loop segment, a high frequency segment, and a low frequency segment. The loop segment has a feeding sub-segment adjacent to the grounding portion and used for being fed with the signal. The high and low frequency segments are extended from opposite ends of the loop segment away from each other. The frequency adjusting portion is connected to the loop segment and the grounding portion. A high frequency dual-path is formed from a feeding point of the feeding sub-segment and extends along the loop segment in two different directions to the high frequency segment. A low frequency dual-path is formed from the feeding point and extends along the loop segment in two different directions to the low frequency segment.

10 Claims, 5 Drawing Sheets

ANTENNA STRUCTURE

BACKGROUND OF THE INVENTION

1. Field of the Invention

The present invention relates to an antenna structure; in particular, to an antenna structure which has a high frequency dual-path and a low frequency dual-path.

2. Description of Related Art

Currently, most wireless communication devices (e.g., mobile phones, notebook computers, tablet PCs, etc.) have an antenna structure to transmit and receive electromagnetic signals as a medium. The antenna structure can be set outside or inside the wireless communication devices.

Among them, the single path antenna structure, as shown in FIG. 6, has a grounding portion 1*a*, a strip-shaped radiation portion 2*a*, and a connecting portion 3*a*. The two ends of the connecting portion 3*a* are respectively and vertically connected to the grounding portion 1*a* and the radiation portion 2*a*. The radiation portion 2*a* can be divided into a high frequency segment 21*a* and a low frequency segment 22*a*. The connecting portion 3*a* is arranged between the high frequency segment 21*a* and the low frequency segment 22*a*. The connecting position between the connecting portion 3*a* and the radiation portion 2*a* is regarded as a feeding point O used for being fed with a signal. Thus, the single path antenna structure has a single high frequency path, a single low frequency path, and a single grounding path.

However, the high frequency efficiency of the single path antenna structure is shown by the broken line A in FIG. 4 by actual test. Whereas the low frequency efficiency of the single path antenna structure is illustrated by the broken line A' shown in FIG. 5 by actual test. The high frequency efficiency and the low frequency efficiency are important parameters in judging whether the antenna structure is serviceable for the antenna designer. Therefore, according to the high frequency efficiency and the low frequency efficiency shown in FIGS. 4 and 5, a person skilled in the art can see the single path antenna structure still has room for improvement.

SUMMARY OF THE INVENTION

The object of the present invention is to provide an antenna structure having a high frequency dual-path and a low frequency dual-path, where the high frequency efficiency and the low frequency efficiency of the antenna structure are better than the single path antenna structure.

An embodiment of the present invention provides an antenna structure used for being fed with a signal, comprising a grounding portion, a radiation portion, and a frequency adjusting portion. The radiation portion is spaced apart on one side of the grounding portion. The radiation portion has a loop segment, a high frequency segment, and a low frequency segment. The loop segment has a feeding sub-segment adjacent to the grounding portion and used for being fed with the signal. The high frequency segment and the low frequency segment are extended from opposite ends of the loop segment away from each other. The frequency adjusting portion is connected to the loop segment of the radiation portion and the grounding portion. The frequency adjusting portion is arranged at one side of the loop segment adjacent to the low frequency segment and spaced apart from the low frequency segment. A high frequency dual-path is formed from a signal-fed point of the feeding sub-segment and extends along the loop segment in two different directions to the high frequency segment. A low frequency dual-path is formed from the signal-fed point of the feeding sub-segment fed and extends along the loop segment in two different directions to the low frequency segment.

Ideally, the loop segment further has a left loop sub-segment, a right loop sub-segment, and a connecting sub-segment. The left loop sub-segment and the right loop sub-segment are bendingly extended from opposite ends of the feeding sub-segment, where opposite ends of the connecting sub-segment are connected to the left loop sub-segment and the right loop sub-segment respectively.

Ideally, the high frequency segment and the low frequency segment are extended from the opposite ends of the connecting sub-segment away from each other.

Ideally, the high frequency segment, the low frequency segment, and the connecting sub-segment are linked to be approximately strip-shaped.

Ideally, the opposite ends of the left and right loop sub-segments are perpendicularly connected to the feeding and connecting sub-segments. The substantial center of the feeding sub-segment is used for being fed with the signal.

Ideally, the frequency adjusting portion has an extended segment, a first grounding segment, and a second grounding segment. One end of the extended segment is connected to the feeding sub-segment. Whereas the opposite ends of the first and second grounding segments are connected to the extended segment and the grounding portion.

Ideally, the first grounding segment is extended away from the loop segment and diagonally extended from one end of the extended segment toward the grounding portion.

Ideally, the opposite ends of the second grounding segment are perpendicularly connected to the extended segment and the grounding portion.

Ideally, the antenna structure further comprises a coupling portion used for being coupled with high frequency segment, where the coupling portion is extended toward the high frequency segment from the grounding portion across from the high frequency segment.

Ideally, the frequency adjusting portion has an extended segment and a first grounding segment. One end of the extended segment is connected to the feeding sub-segment, where opposite ends of the first grounding segment are respectively connected to the extended segment and the grounding portion. The first grounding segment is extended away from the loop segment and diagonally extended from one end of the extended segment toward the grounding portion.

In conclusion, the high frequency efficiency and the low frequency efficiency of the antenna structure of the instant disclosure comparing to the single path antenna structure (prior art) can be improved obviously by having the radiation portion to form the high frequency dual-path and the low frequency dual-path.

In order to further the understanding regarding the present invention, the following embodiments are provided along with illustrations to facilitate the disclosure of the present invention.

DETAILED DESCRIPTION OF THE PREFERRED EMBODIMENTS

Figure 1:
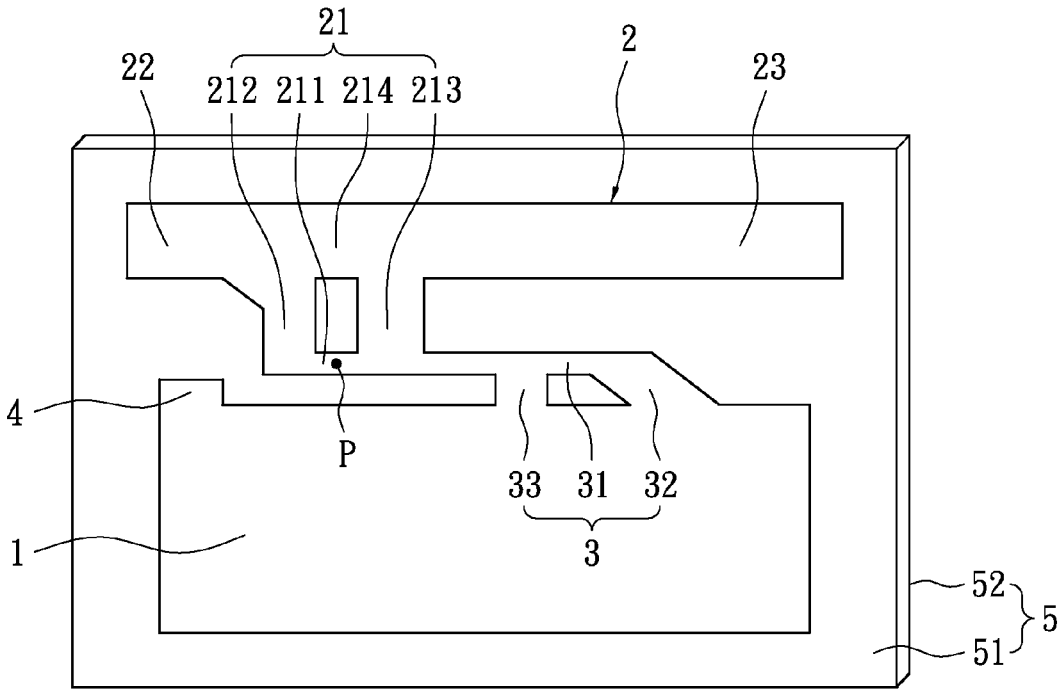
FIG. 1 shows a schematic view of one type of the instant disclosure.
Figure 2:
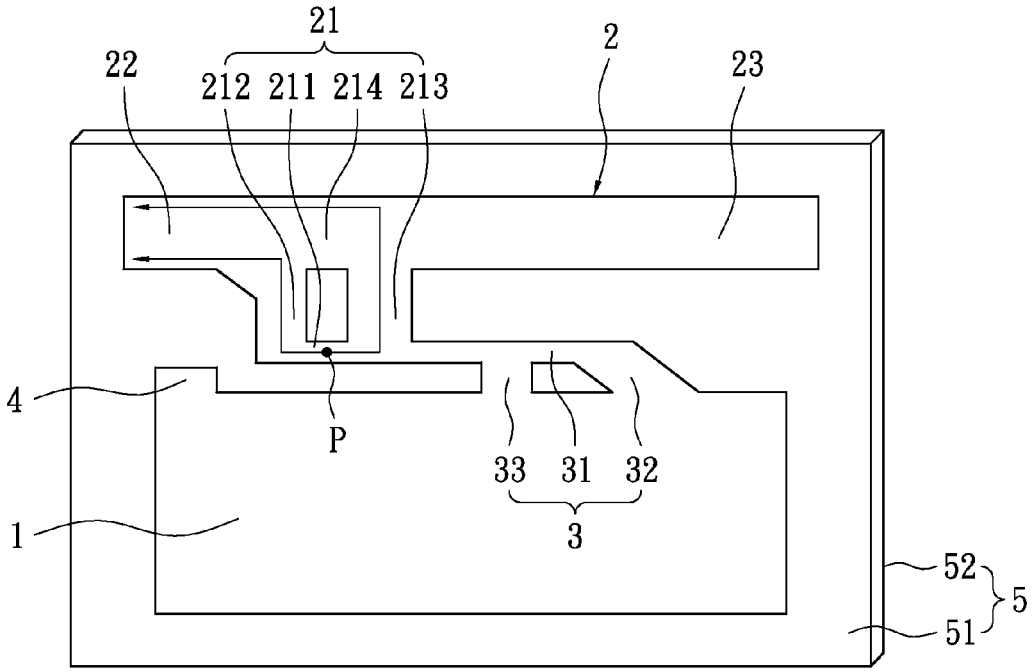
FIG. 2 shows a schematic view of high frequency dual-path of the instant disclosure.
Figure 3:
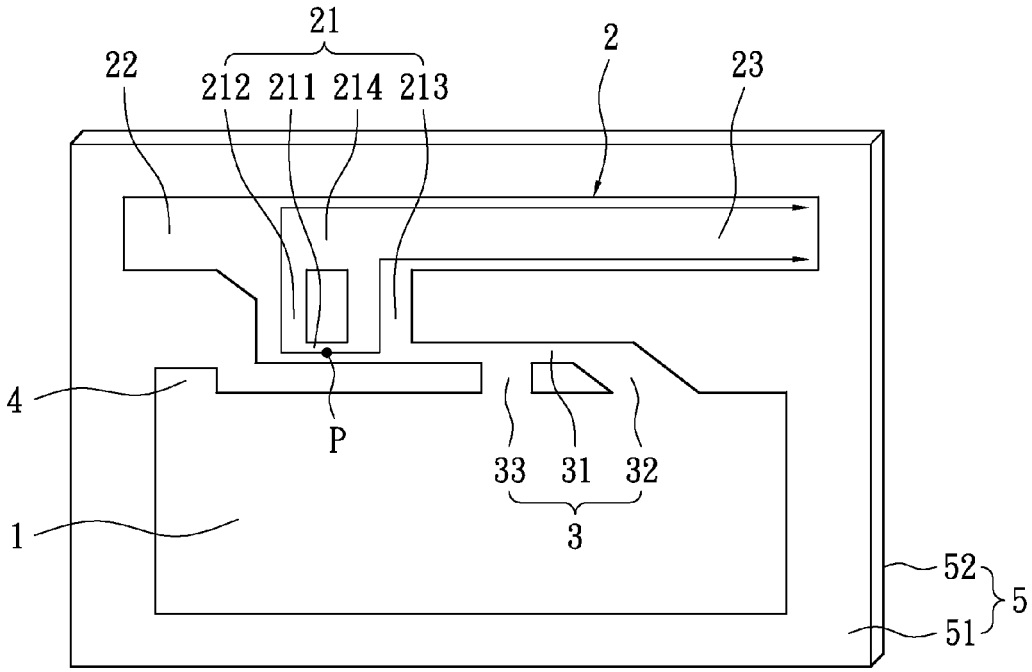
FIG. 3 shows a schematic view of low frequency dual-path of the instant disclosure.
Figure 4:
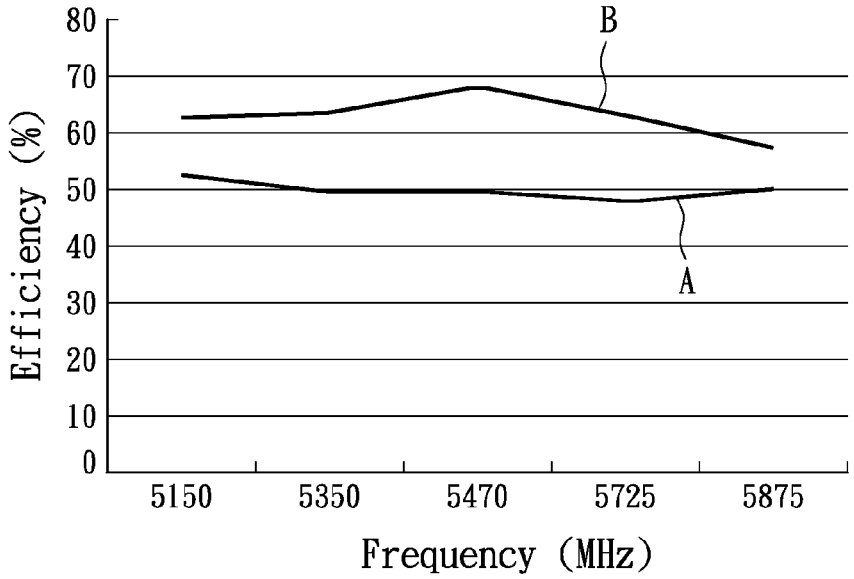
FIG. 4 shows a plot of the high frequency efficiency of the instant disclosure and the single path antenna structure.
Figure 5:
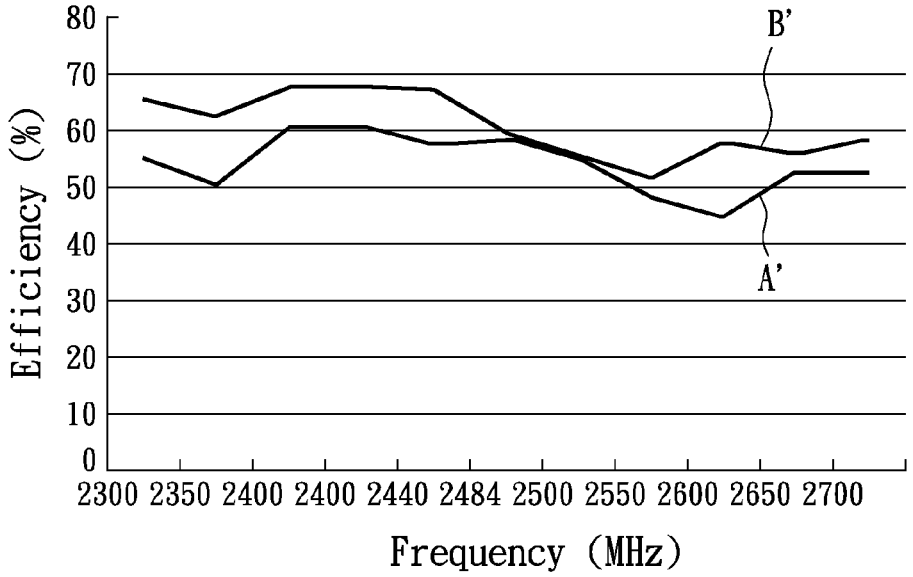
FIG. 5 shows a plot of the low frequency efficiency of the instant disclosure and the single path antenna structure.

With reference to FIGS. 1 to 5, which show the instant disclosure. Specifically, FIGS. 1 to 3 show the schematic views of the instant disclosure, while FIGS. 4 and 5 show the experimental results of the testing done on the instant disclosure and the single path antenna structure.

Please refer to FIG. 1, which shows an antenna structure formed on a substrate plate 5 and used for being fed with a signal. The antenna structure includes a grounding portion 1, a radiation portion 2, a frequency adjusting portion 3, and a coupling portion 4.

The substrate plate 5 has an opposite first surface 51 and a second surface 52. In the embodiment, the antenna structure of the instant disclosure is formed on the first surface 51 of the substrate plate 5, but in practice, the antenna structure can also be formed on the second surface 52 of the substrate plate 5. In addition, the substrate plate 5 is flat-shaped in this embodiment, but when in use, the substrate plate 5 is not limited thereto, for example, the substrate plate 5 can be bend-shaped.

The antenna structure of the instant disclosure can be used for tablet PCs, notebook computers, mobile phones, or other wireless communication devices. Furthermore, in this embodiment, the shape of each segment of the antenna structure shown in the figures is taken as an example, but in actual use, the shape of each segment of the antenna structure can be changed by the designer, for example, each segment of the antenna structure can be changed to wave-shaped.

The radiation portion 2 is spaced apart from one side of the grounding portion 1. The radiation portion 2 has a loop segment 21, a high frequency segment 22, and a low frequency segment 23. The loop segment 21 can be used for being fed with a signal. The high frequency segment 22 and the low frequency segment 23 are extended from opposite ends of the loop segment 21 away from each other.

Thus, a high frequency dual-path is formed from a signal-fed point of the loop segment 21 by traversing along the loop segment 21 in a direction toward the high frequency segment 22 (as shown by the arrows in FIG. 2). Moreover, a low frequency dual-path is formed from the signal-fed point of the loop segment 21 by traversing along the loop segment 21 in a direction toward the low frequency segment 23 (as shown by the arrows in FIG. 3).

More specifically, the loop segment 21 has a feeding sub-segment 211, a left loop sub-segment 212, a right loop sub-segment 213, and a connecting sub-segment 214. The feeding sub-segment 211 is arranged adjacent to the grounding portion 1 and parallel to the corresponding outer edge of the grounding portion 1. The substantial center of the feeding sub-segment 211 is regarded as a feeding point P for being fed with the signal.

The left loop sub-segment 212 and the right loop sub-segment 213 are extended away from the grounding portion 1 from opposite ends of the feeding sub-segment 211. In other words, the opposite ends of the feeding sub-segment 211 are respectively and perpendicularly connected to the left loop sub-segment 212 and the right loop sub-segment 213.

The connecting sub-segment 214 is parallel to the feeding sub-segment 211. The opposite ends of the connecting sub-segment 214 are respectively and perpendicularly connected to the left loop sub-segment 212 and the right loop sub-segment 213.

The high frequency segment 22 and the low frequency segment 23 are extended from opposite ends of the connecting sub-segment 214 away from each other. In addition, the high frequency segment 22 and the low frequency segment 23 are parallel to the feeding sub-segment 211. In other word, the high frequency segment 22, the low frequency segment 23, and the connecting sub-segment 214 are connected to be approximately strip-shaped.

The frequency adjusting portion 3 is connected to the loop segment 21 of the radiation portion 2 and the grounding portion 1. The frequency adjusting portion 3 is arranged at one side of the loop segment 21 adjacent to the low frequency segment 23 and spaced apart from the low frequency segment 23.

In more detail, the frequency adjusting portion 3 has an extended segment 31, a first grounding segment 32, and a second grounding segment 33. The extended segment 31 is parallel to the low frequency segment 23. The extended segment 31 is connected to one end of the feeding sub-segment 211 away from the high frequency segment 22 and extends in a direction away from the high frequency segment 22.

The opposite ends of the first grounding segment 32 and the second grounding segment 33 are connected to the extended segment 31 and the grounding portion 1. The first grounding segment 32 is extended from one end of the extended segment 31 in a direction away from the loop segment 21 and diagonally toward the grounding portion 1. The opposite ends of the second grounding segment 33 are respectively and perpendicularly connected to the extended segment 31 and the grounding portion 1.

Figure 1A:
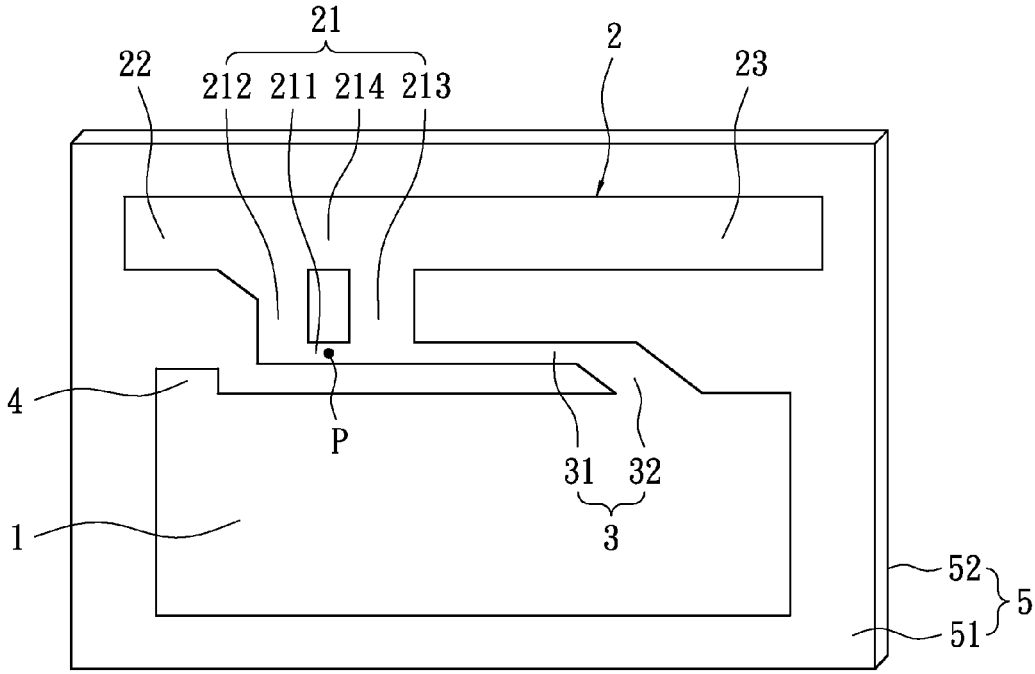
FIG. 1A shows a schematic view of another type of the instant disclosure.

In addition, the length of each segment of the frequency adjusting portion 3 can be changed by the designer so as to adjust the bandwidth of the antenna structure. Besides, in this embodiment, the frequency adjusting portion 3 has the first grounding segment 32 and the second grounding segment 33, but in use, the frequency adjusting portion 3 can just has the first grounding segment 32 (as FIG. 1A shown) or the second grounding segment 33 (not shown).

The coupling portion 4 is used for being coupled with the high frequency segment 22 so as to increase the high frequency efficiency of the antenna structure. The coupling portion 4 is extended toward the high frequency segment 22 from the grounding portion 1 across the high frequency segment 22. Moreover, the length of the coupling portion 4 is smaller than the distance between the feeding sub-segment 211 and the grounding portion 1, but not limited thereto.

Figure 1B:
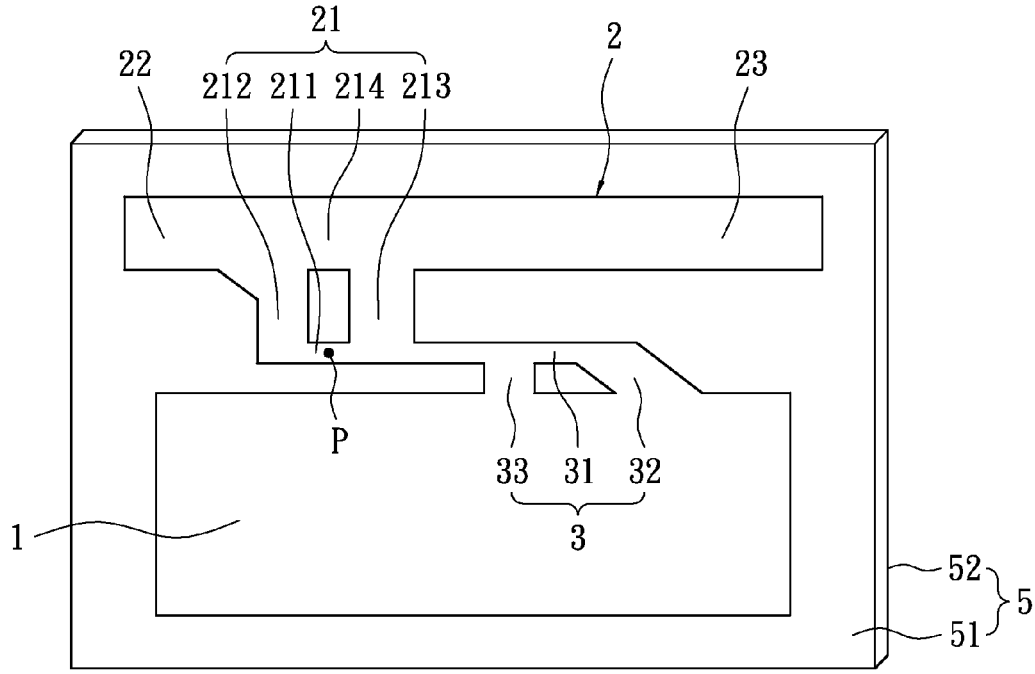
FIG. 1B shows a schematic view of yet another type of the instant disclosure.

However, in this embodiment, the antenna structure has the coupling portion 4, but in use, the antenna structure can leave out the coupling portion 4 (as FIG. 1B shown).

Based on the above, the high frequency dual-path of the antenna structure (as FIG. 2 shown) is formed by traversing from the point of the feeding sub-segment 211 fed with the signal (the feeding point P) toward a leftward direction along the left loop sub-segment 212 to the high frequency segment 22 and in a rightward direction along the right loop sub-segment 213 and the connecting sub-segment 214 to the high frequency segment 22. Additionally, a grounding dual-path of the antenna structure is formed from the feeding point P along the extended segment 31, and then, respectively along the first grounding segment 32 and the second grounding segment 33 to the grounding portion 1.

Thus, the antenna structure as FIG. 1 shown can be used for increasing the high frequency efficiency by the described structural design (such as the high frequency dual-path, the grounding dual-path, and the coupling portion 4 coupled with the high frequency segment 22).

Figure 6:
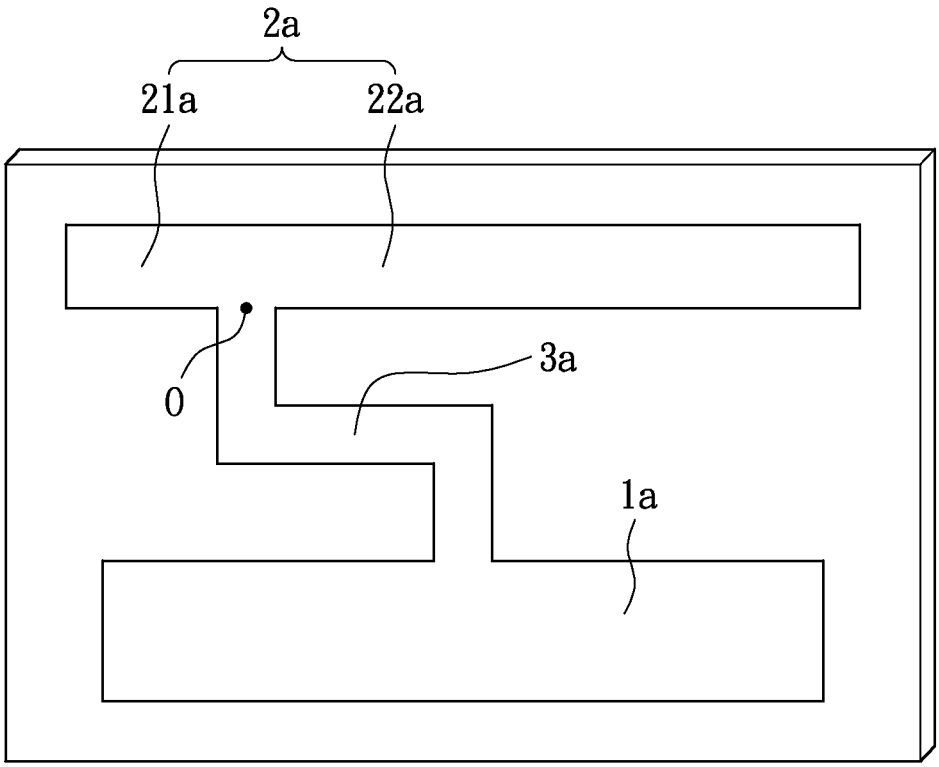
FIG. 6 RELATED ART
FIG. 6 shows a schematic view of the single path antenna structure.

Referring to FIG. 4, the broken line B is the high frequency efficiency of the antenna structure obtained by testing, and the broken line A is the high frequency efficiency of the single path antenna structure as FIG. 6 shown. According to FIG. 4, the high frequency efficiency of the antenna structure of the instant disclosure is obviously better than the prior art (the single path antenna structure) by the structure design, thus the instant disclosure provides the user with the antenna structure having better high frequency efficiency.

Moreover, the low frequency dual-path of the antenna structure (as FIG. 3 shown) is formed by the point of the feeding sub-segment 211 fed with the signal (the feeding point P) respectively extended in a leftward direction along the left loop sub-segment 212 and the connecting sub-segment 214 to the low frequency segment 23 and in a rightward direction along the right loop sub-segment 213 to the low frequency segment 23.

Thus, the antenna structure as FIG. 1 shown can be used for increasing the low frequency efficiency by the described structural design (such as the low frequency dual-path and the grounding dual-path).

Referring to FIG. 5, the broken line B' is the low frequency efficiency of the antenna structure gotten by actual test, and the broken line A' is the low frequency efficiency of the single path antenna structure as FIG. 6 shown. According to FIG. 5, the low frequency efficiency of the antenna structure of the instant disclosure is obviously better than the prior art (the single path antenna structure) by the structure design, thus the instant disclosure provides the user with the antenna structure having better low frequency efficiency.

According to the embodiment, the high frequency efficiency and the low frequency efficiency of the antenna structure of the instant disclosure comparing to the single path antenna structure (prior art) can be improved obviously by structure design (such as the high frequency dual-path, the low frequency dual-path, the grounding dual-path, and the coupling portion 4 coupled with the high frequency segment 22). Therefore, the instant disclosure provides the user with the antenna structure having better high and low frequency efficiency.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An antenna structure used for being fed with a signal, comprising:

a grounding portion;

a radiation portion spaced apart on one side of the grounding portion, wherein the radiation portion has a loop segment, a high frequency segment, and a low frequency segment, wherein the loop segment has a feeding sub-segment adjacent to the grounding portion and used for being fed with the signal, wherein the high frequency segment and the low frequency segment are extended from two opposite ends of the loop segment away from each other; and a frequency adjusting portion connected to the loop segment of the radiation portion and the grounding portion, wherein the frequency adjusting portion is arranged at one side of the loop segment adjacent to the low frequency segment and spaced apart from the low frequency segment, wherein a high frequency dual-path is formed from a point of the feeding sub-segment fed with the signal and extends along the loop segment in two different directions to the high frequency segment, wherein a low frequency dual-path is formed from the point of the feeding sub-segment fed with the signal and extends along the loop segment in two different directions to the low frequency segment.

2. The antenna structure as claimed in claim 1, wherein the loop segment further has a left loop sub-segment, a right loop sub-segment, and a connecting sub-segment, wherein the left loop sub-segment and the right loop sub-segment are extended from opposite ends of the feeding sub-segment, and wherein the opposite ends of the connecting sub-segment are connected to the left loop sub-segment and the right loop sub-segment respectively.

3. The antenna structure as claimed in claim 2, wherein the high frequency segment and the low frequency segment are extended from the opposite ends of the connecting sub-segment away from each other.

4. The antenna structure as claimed in claim 3, wherein the high frequency segment, the low frequency segment, and the connecting sub-segment are connected to be approximately strip-shaped.

5. The antenna structure as claimed in claim 3, wherein the opposite ends of the left loop sub-segment and the right loop sub-segment are perpendicularly connected to the feeding sub-segment and the connecting sub-segment, and wherein the substantial center of the feeding sub-segment is used for being fed with the signal.

6. The antenna structure as claimed in claim 1, wherein the frequency adjusting portion has an extended segment, a first grounding segment, and a second grounding segment, wherein one end of the extended segment is connected to the feeding sub-segment, and wherein the opposite ends of the first grounding segment and the second grounding segment are connected to the extended segment and the grounding portion.

7. The antenna structure as claimed in claim 6, wherein the first grounding segment is extended from one end of the extended segment in a direction away from the loop segment and diagonally toward the grounding portion.

8. The antenna structure as claimed in claim 7, wherein the opposite ends of the second grounding segment are connected to the extended segment and the grounding portion.

9. The antenna structure as claimed in claim 1, further comprising a coupling portion used for being coupled with high frequency segment, wherein the coupling portion is extended toward the high frequency segment from the grounding portion across from the high frequency segment.

10. The antenna structure as claimed in claim 9, wherein the frequency adjusting portion has an extended segment and a first grounding segment, wherein one end of the extended segment is connected to the feeding sub-segment, wherein the opposite ends of the first grounding segment are connected to the extended segment and the grounding portion, and wherein the first grounding segment is extended from one end of the extended segment away from the loop segment in a diagonal direction toward the grounding portion.

* * * * *